US006068150A

United States Patent [19]

Mitchell et al.

[11] Patent Number: 6,068,150

[45] Date of Patent: May 30, 2000

[54] ENCLOSURE CAP FOR MULTIPLE PIERCING

[75] Inventors: John Allen Mitchell; Kimberlee Elizabeth Guitar; David Borenstein, all of Miami, Fla.

[73] Assignee: Coulter International Corp., Miami, Fla.

[21] Appl. No.: 09/238,698

[22] Filed: Jan. 27, 1999

[51] Int. Cl.[7] ..... B65D 39/00

[52] U.S. Cl. ..... 215/247; 215/276

[58] Field of Search ..... 215/247, 249, 215/276

[56] References Cited

U.S. PATENT DOCUMENTS

| | | | |
|---|---|---|---|
| 2,848,130 | 8/1958 | Jesnig | 215/247 X |
| 2,923,427 | 2/1960 | Klopfenstein | 215/247 X |
| 4,193,402 | 3/1980 | Rumpler | 215/247 X |
| 4,202,334 | 5/1980 | Elson | 215/247 X |
| 4,230,231 | 10/1980 | Burnett et al. | 215/329 |
| 4,915,243 | 4/1990 | Tatsumi et al. | 215/247 |
| 5,232,109 | 8/1993 | Tirrell et al. | 215/247 |
| 5,294,011 | 3/1994 | Konrad et al. | 215/247 |
| 5,297,599 | 3/1994 | Bucheli | 215/276 X |

*Primary Examiner*—Stephen K. Cronin
*Attorney, Agent, or Firm*—Mitchell E. Alter

[57] ABSTRACT

An elastic stopper and an enclosure cap incorporating the stopper for sealing a vial while allowing piercing of the stopper. The stopper includes a disk-shaped upper portion and a cylindrical-shaped lower portion defining an interior hollow space. The lower portion is divided into a plurality of longitudinal segments by a plurality of slots. A plurality of longitudinal grooves are provided on the inside surface of the lower portion to break the surface tension between the stopper and the liquid contents of the vial that flow into the hollow space of the cap. The enclosure cap allows multiple piercing without leakage of the vial contents and prevents the vial contents from aspirating out when the stopper is pierced with a single lumen needle.

10 Claims, 6 Drawing Sheets

ENCLOSURE CAP FOR MULTIPLE PIERCING

BACKGROUND OF THE INVENTION

1. Field of the Invention

The present invention relates to a stopper and an enclosure cap for a vial incorporating the stopper, and in particular to a cap and stopper that allow multiple piercing.

2. Description of the Related Art

Enclosure caps incorporating elastic stoppers for sealing screw-cap type glass vials are generally known. One prior art enclosure cap is described in U.S. Pat. No. 4,230,231 to Burnett et al. FIGS. 8A and 8B illustrate a prior art cap 110 incorporating a stopper 124 for sealing a vial 116. The stopper 124 has a disk-like upper part and a lower part, the lower part being divided by three equally spaced slots 126 into three flexible equal-length segments 128. The segments 128 surround an interior hollow space 130 which is longer than the slots 126. The stopper 124 is made of an elastic material such as rubber and is bonded to a cap body to form an integral cap 110. When the cap 110 is screwed onto the vial 116, the flexible lower portion of the stopper is inserted into the opening of the vial, thereby sealing the same. The cap body has an opening at the top to expose a central portion of the stopper, allowing piercing through the stopper by a needle to withdraw the liquid contents of the vial.

Such caps are used for air and liquid-tight sealing of a vial while allowing withdrawal of the vial contents by piercing with a needle. Prior to piercing, the vial contents are typically mixed by a rocking motion of the vial. A disadvantage of some prior art enclosure caps is that the contents of the vial may be retained in the hollow portion of the stopper after the rocking motion. Thus, when the stopper is pierced with a single lumen needle, the vial contents that are retained inside the hollow space of the stopper tend to be forced out through the piercing hole around the needle.

SUMMARY OF THE INVENTION

It is an object of the present invention to provide an enclosure cap for a vial that allows a large number of piercing operations without leakage of the vial contents.

It is another object of the present invention to provide an enclosure cap that prevents the vial contents from aspirating out during piercing after a mixing operation.

These and other aspects, features and advantages of the present invention will be better understood by studying the detailed description in conjunction with the drawings and the accompanying claims.

According to an embodiment of the present invention, a stopper for an enclosure cap used for sealing a vial is formed from an elastic material and comprises a disk-shaped top portion, and a substantially cylindrical-shaped lower portion coaxially extending from a bottom surface of the top portion to define a hollow interior space, the lower portion defining at least one longitudinal groove on an inner surface thereof surrounding the hollow interior space.

According to another embodiment of the present invention, an enclosure cap for sealing a vial comprises a cylindrical cap body having an opening at a bottom end and interior threads for engaging the exterior threads on the vial, and a stopper formed of an elastic material, the stopper having a disk-shaped top portion and a substantially cylindrical-shaped lower portion coaxially extending from a bottom surface of the top portion to define a hollow interior space, the lower portion defining at least one longitudinal groove on an inner surface thereof surrounding the hollow interior space, the top portion having a diameter substantially the same as the inner diameter of the cap body and the lower portion having an outer diameter substantially the same as an inner diameter of the vial opening, the stopper being disposed substantially inside the cylindrical cap body. According to another aspect of the present invention, the cap body defines an opening at a top end surrounded by a lip portion to expose a portion of the top surface of the top portion of the stopper.

According to another aspect of the present invention, a distal end of the lower portion is divided into a plurality of longitudinal segments by a plurality of longitudinal space slots.

DETAILED DESCRIPTION OF THE PREFERRED EMBODIMENTS

Figure 1:
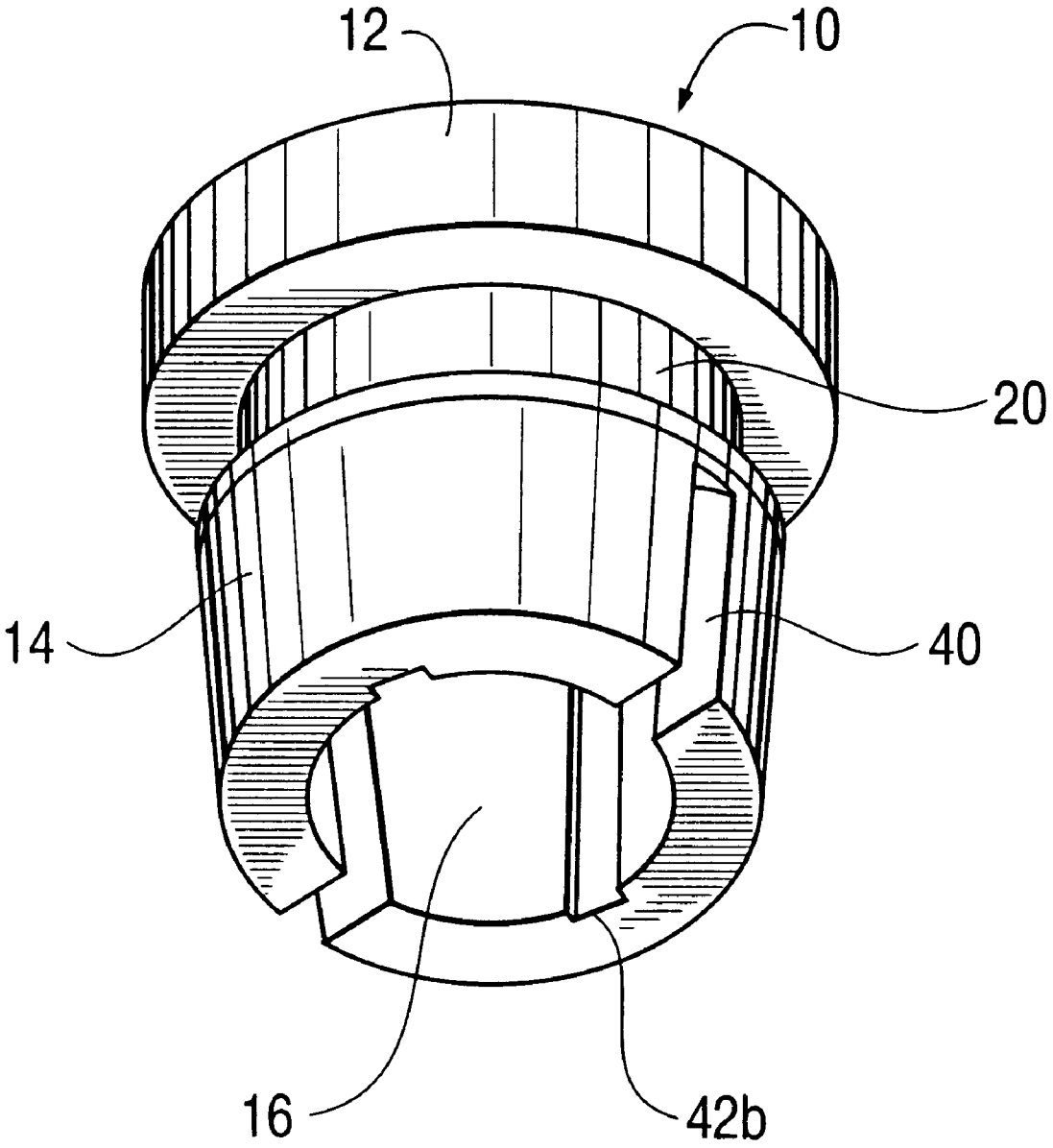
FIG. 1 is a perspective view of a stopper according to an embodiment of the present invention.
Figure 2:
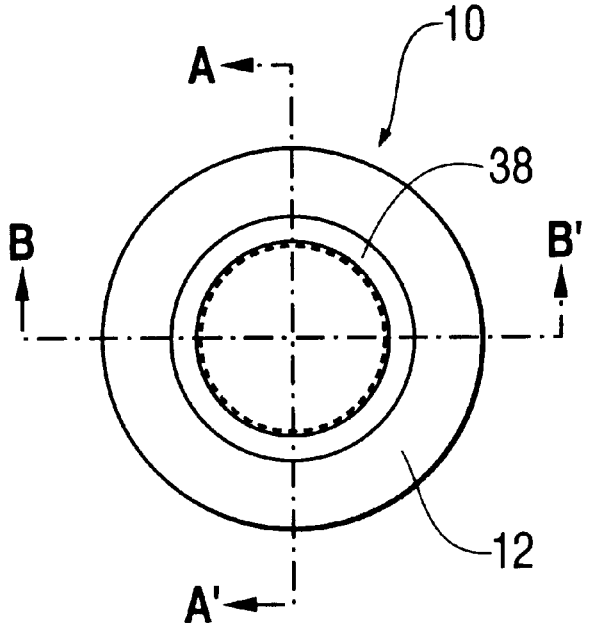
FIG. 2 is a top view of the stopper of FIG. 1.
Figure 3:
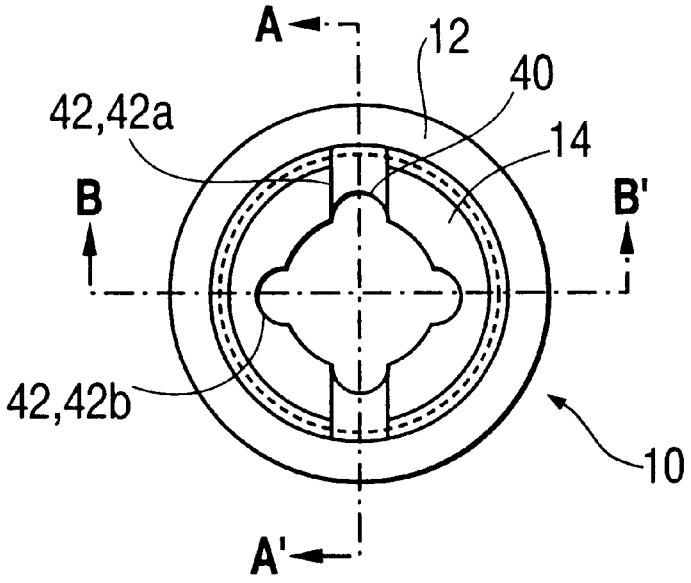
FIG. 3 is a bottom view of the stopper of FIG. 1.
Figure 4:
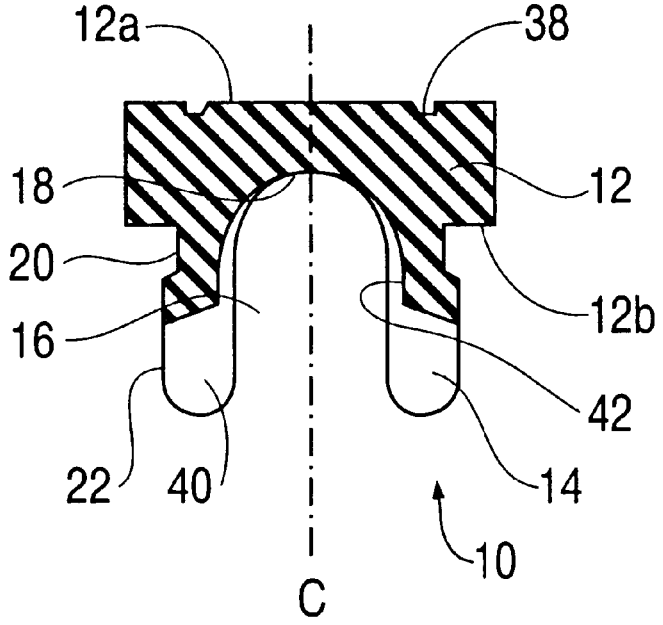
FIG. 4 is a section view of the stopper of FIG. 1 along the lines A–A' in FIGS. 2 and 3.
Figure 5:
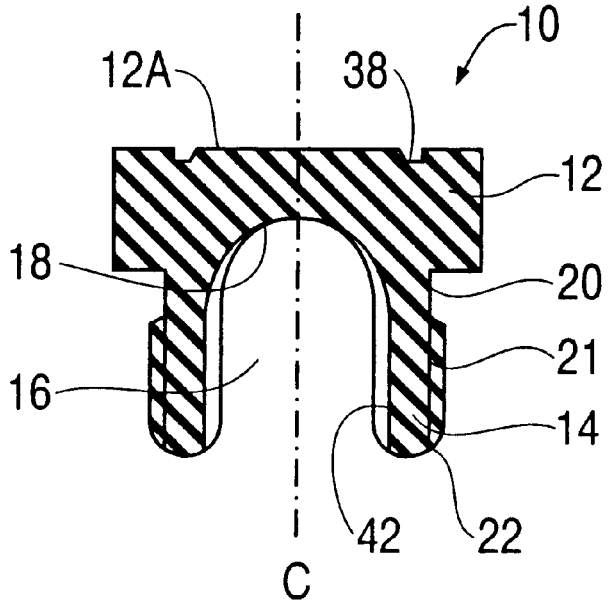
FIG. 5 is a section view of the stopper of FIG. 1 along the lines B–B' in FIGS. 2 and 3.

FIGS. 1–5 illustrate a stopper 10 according to an embodiment of the present invention. The stopper 10 has a disk-shaped upper portion 12 having a flat top face 12*a*, and a substantially cylindrical-shaped lower portion 14 extending downwardly and coaxially from the bottom face of the upper portion. The lower portion 14 has an outer diameter smaller than the diameter of the top portion 12. The cylindrical-shaped lower portion 14 surrounds an interior hollow space 16, which is bound at a proximate or top end by a smooth recess 18 on the bottom face of the upper portion 12. The lower portion 14 has a neck portion 20 at the proximate end, which has a smaller outer diameter than a middle part 21. The neck portion is an optional feature that is useful when employed with a plastic vial which contains an interior lip which would be seated in said neck portion to prevent stopper blow back caused by increased pressure occurring when the stopper is inserted into the vial. The outer surface 22 of the distal end of the lower portion 14 tapers inwardly, preferably at an angle of about 5° with respect to a longitudinal axis C of the stopper. This feature provides ease of stopper insertion into the vial. The stopper 10 is formed of a highly elastic material, such as rubber, by a suitable method, such as molding.

Figure 6:
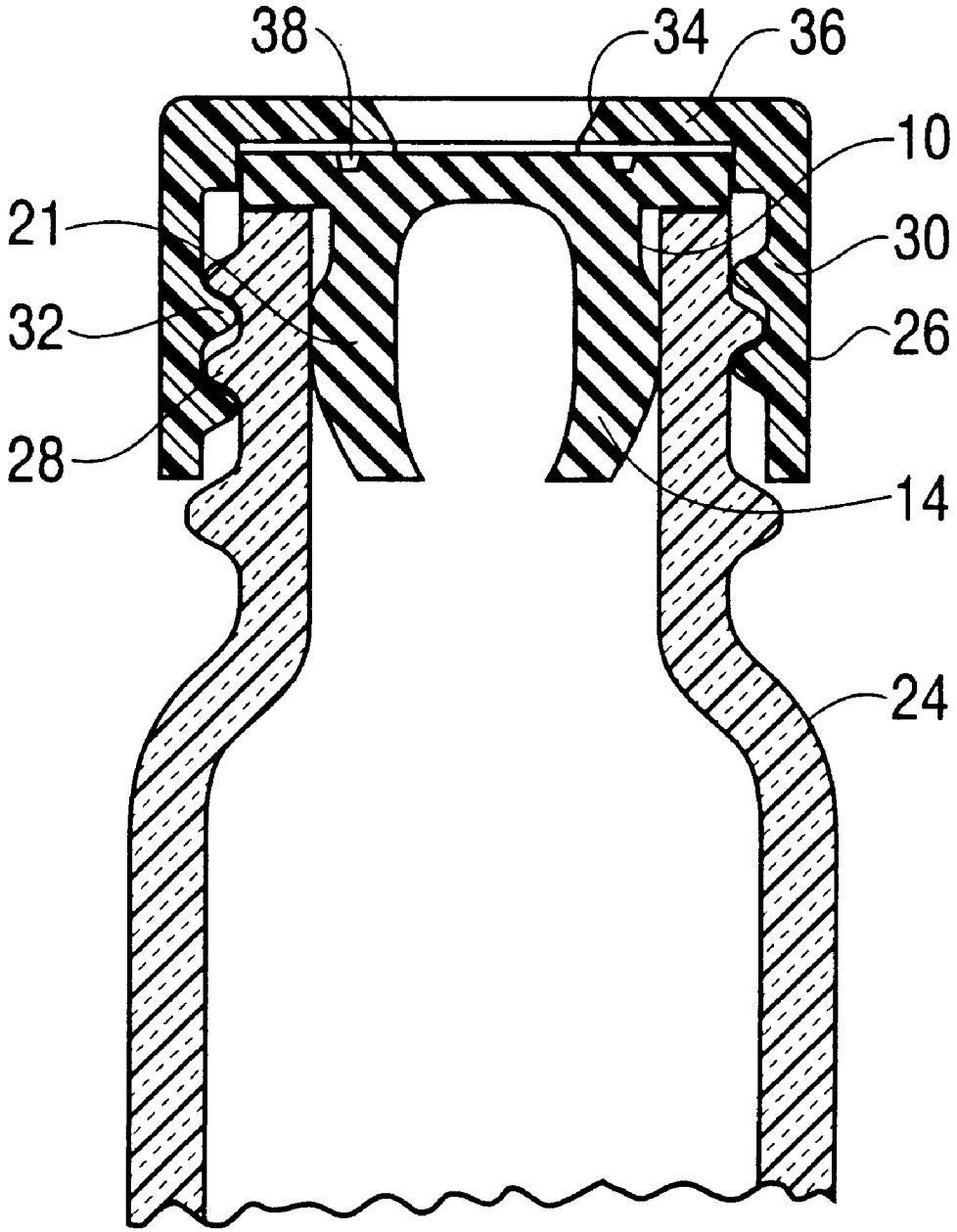
FIG. 6 is a section view of an enclosure cap incorporating the stopper of FIG. 1 used to seal a glass vial.
Figure 7:
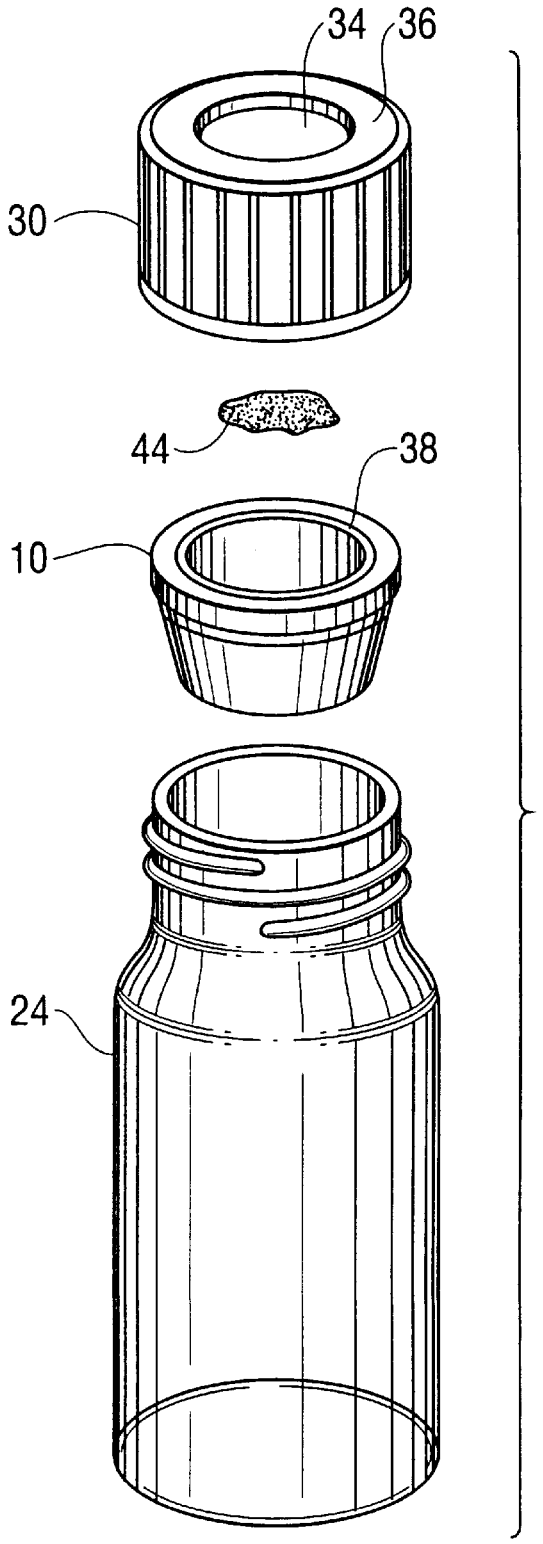
FIG. 7 is an exploded view of the enclosure cap and the vial of FIG. 6.
Figure 8A:
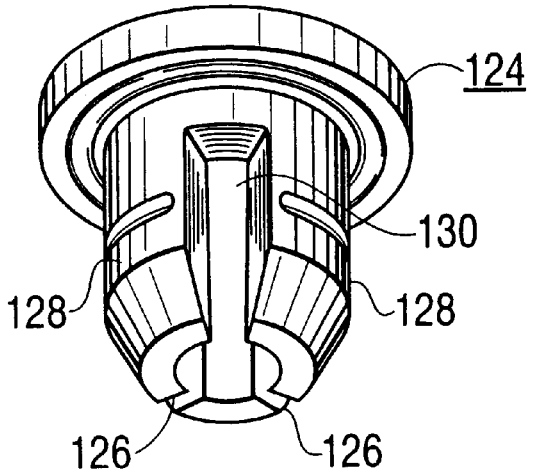
FIG. 8A is a perspective view of a prior art stopper.
Figure 8B:
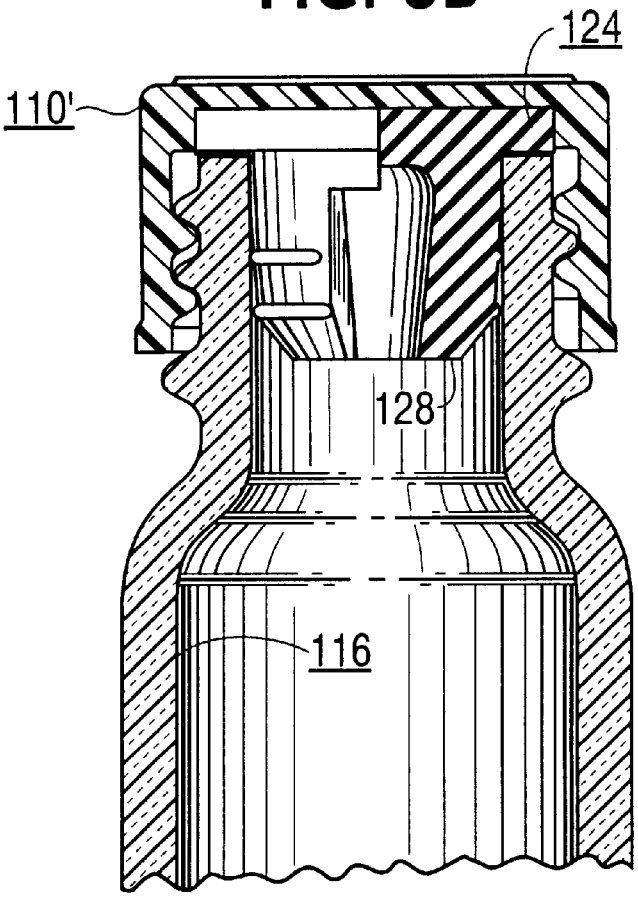
FIG. 8B is a sectional view of a vial and a prior art cap incorporating the stopper of FIG. 8A.

FIG. 6 is a section view illustrating a vial 24 sealed by an enclosure cap 26 incorporating the stopper 10. FIG. 7 is an exploded view showing the vial 24, the stopper 10 and a body 30 of the cap. The vial 24 is, for example, a screw-cap type glass vial well known in the art and has a uniformly dimensioned opening in a neck portion having exterior threads 28. The enclosure cap 26 has a tubular body 30 having an open end at the bottom. The body 30 is preferably formed of a hard plastic material. Interior threads 32 are provided on the cap body 30 to engage the exterior threads 28 of the vial 24 when the cap is screwed on the vial. The cap is tightened on the vial by a twisting motion. The top end of the cap body 30 has a round opening 34 surrounded by an annular lip portion 36. The diameter of the upper portion 12 of the stopper 10 is larger than the diameter of the vial opening, and the outer diameter of the middle part 21 of the lower portion of the stopper is slightly larger in an unflexed condition than the diameter of the vial opening. As a result, when the enclosure cap 26 is screwed on the vial 24, the upper portion 12 is retained between the lip portion 36 and the rim of the vial, with the lower portion 14 inserted into the vial opening.

The stopper 10 is disposed inside of and bonded to the cap body 30 to form an integral enclosure cap 26. The stopper may be either longer or shorter than, or is substantially the same length as the cap body. Preferably, the stopper 10 is bonded to the cap 24 by an adhesive 44 at an interface between the underside of the lip portion 36 of the cap and the outer peripheral of the top surface 12*a* of the stopper. The type of adhesive used may be, for example, Prism® 401 adhesive from Loctite Corporation, (1001 Trout Brook Crossing, Rocky Hill, Conn. 06067). However, other surface adhesives known to those skilled in the art can be used. Preferably, a groove such as an annular groove 38 having a diameter larger than the diameter of top opening 34 of the cap body 30 is provided on the top surface 12*a* of the stopper 10, the groove being located at the interface between the lip portion 36 and the stopper to accommodate any excessive adhesive that is applied to bond the stopper to the cap body. The integral enclosure cap 26 incorporating the stopper 10 can be repeatedly screwed on and removed from the vial 24.

The opening 34 in the cap body 30 allows piercing of the stopper 10 by a needle when the enclosure cap 26 is screwed on the vial 24. The elastic material used to form the stopper 10 provides resealing of the piercing hole, thereby allowing multiple piercing without leakage of the contents of the vial. In one preferred embodiment, the elastic material used is a rubber product manufactured by The Plasticoid Company (249 W. High Street, Elkton, Md. 21921) under the trade name "345 Red". The rubber is cured using the normal curing method, has a hardness of 40±5 shore a (units of measure being "shore a"), a specific gravity of 1.20 g/cm$^3$, a tensile strength of 2800 psi, a modules of 350% of 450 psi, and an elongation of 350%. As recognized by those skilled in the art, other suitable material may also be used to form the stopper, such as a rubber product manufactured by The Plasticoid Company under the trade name "Material 115-1 Pure Gum". The primary difference between Material 115-1 and 345 Red is the hardness of the material. Material 115-1 has more elasticity and is useful for multiple piercing with a sharp needle. If the needle is a blunt nose needle, multiple piercing, in excess of 30 punctures, will tend to cause the stopper to push in the vial. In addition to the suitable material used, the geometrical design of the stopper, particularly the thickness of the piercing area, also affects the piercing property of the enclosure cap 26. The piercing area of the stopper refers to the area exposed to the opening 34 of the cap body, which substantially correspond to the recessed area 18 on the bottom surface of the top portion 12. It has been found that when using a commonly available vial of approximately 13 millimeters (outside diameter)× approximately 62 millimeter in length that the piercing thickness is preferably 0.070 to 0.090 inches. Prior art stoppers for 13 mm×62 mm vials generally have a thickness of approximately 0.130 to 0.150 inches. However, it has been found that when using the 345 Red that a thickness less than 0.065 inches has a tendency to leak the contents from the vial because the stopper fails to reseal, and when using a thickness of greater than 0.090 inches requires greater pressure to pierce the stopper which affects needle life. In one experiment, an enclosure cap according to a preferred embodiment having a piercing thickness of 0.080 inches (2 mm) and using the above-described rubber material allowed a maximum of about 228 piercing without any leakage of the vial contents.

Referring back to FIGS. 1–5, the lower portion 14 of the stopper 10 is divided into a plurality of longitudinal segments by a plurality of longitudinal space slots 40. The slots are preferably equal-spaced. Two longitudinal segments with two diagonally opposed slots are shown in the illustrated embodiment of FIG. 1, but a different number of segments may also be employed provided that the stopper remains secure in the vial. The depth of the space slots (shown by space slot 40 in view of FIG. 1) in the longitudinal direction is such that they do not cut into the neck portion 20. The slots provide an advantage of retarding a bubble from forming at the distal end 12 of the stopper. This advantage is not provided by grooves.

In addition, a plurality of longitudinal, preferably equal-spaced grooves 42 are provided on the inner surface of the lower portion 14. Four grooves are shown in the illustrated embodiment of FIGS. 1–5, two of which 42*a* are located at the same angular positions as the slots 40 and extend upwardly from the ends of the slots, and two of which 42*b* are located on the inner surface of the two longitudinal segments 14*a* at equal distances from the slots and extend upwardly from the bottom rim of the lower portion 14. The plurality of longitudinal grooves 42 extend to the same height near the top 18 of the hollow space 16. The grooves 42 preferably have a smooth, such as round, cross-section when viewed in the longitudinal direction, but they may also have a rectangular cross-section. The grooves 42 function is to break the surface tension between the liquid vial contents and the inner surface of the stopper, allowing the content that flows into the hollow space 16 inside the stopper during mixing operation to drain back into the vial. This prevents the vial contents from being retained inside the hollow space prior to piercing, thereby preventing it from aspirating out when the stopper is pierced with a single lumen needle. It has been found that when using a commonly available vial of approximately 13 mm×approximately 62 mm that the grooves will have a width of approximately 0.06±0.010 inches and a radius of approximately 0.03±0.010 inches.

While the above description refers to particular embodiments of the present invention, it will be understood that many modifications may be made without departing from the spirit thereof. The accompanying claims are intended to cover such and other modifications as would fall within the scope and spirit of the present invention.

What is claimed is:

1. A stopper for an enclosure cap used for sealing a vial, the stopper being formed from an elastic material and comprising a disk-shaped top portion, and a substantially cylindrical-shaped lower portion coaxially extending from a bottom surface of the top portion to define a hollow interior space, the lower portion defining at least one longitudinal groove on an inner surface thereof surrounding the hollow interior space, and wherein a distal end of the lower portion is divided into a plurality of longitudinal segments by a plurality of longitudinal space slots.

2. The stopper of claim 1, wherein the distal end of the lower portion is divided into two longitudinal segments by two longitudinal space slots, and wherein the lower portion defines four longitudinal grooves, the first and second grooves being located at the same angular positions as the space slots and extending upwardly from an end of the space slots, and the third and fourth grooves being located on the two longitudinal segments at equal distances from the space slots and extending from a rim of the longitudinal segments upwardly to the same height as the first and second grooves.

3. The stopper of claim 1, wherein the elastic material is rubber, and wherein the stopper is a single member formed by molding the elastic material.

4. The stopper of claim 1, wherein a central portion of the top portion is about 0.070 to 0.090 inches thick.

5. An enclosure cap for sealing a vial, the vial having an opening and exterior threads on a neck around the opening, the cap comprising:

a cylindrical cap body having an opening at a bottom end and interior threads for engaging the exterior threads on the vial;

a stopper formed of an elastic material, the stopper having a disk-shaped top portion and a substantially cylindrical-shaped lower portion coaxially extending from a bottom surface of the top portion to define a hollow interior space, the lower portion defining at least one longitudinal groove on an inner surface thereof surrounding the hollow interior space, the stopper being disposed substantially inside the cylindrical cap body; and a distal end of the lower portion is divided into a plurality of longitudinal segments by a plurality of longitudinal space slots.

6. The enclosure cap of claim 5, wherein the top portion of the stopper has a diameter substantially the same as the inner diameter of the cap body, and wherein the lower portion of the stopper has an outer diameter substantially the same as an inner diameter of the vial opening.

7. The enclosure cap of claim 5, wherein the cap body defines an opening at a top end surrounded by a lip portion to expose a portion of the top surface of the top portion of the stopper.

8. The stopper of claim 5, wherein the distal end of the lower portion is divided into two longitudinal segments by two longitudinal space slots, and wherein the lower portion defines four longitudinal grooves, the first and second grooves being located at the same angular positions as the space slots and extending upwardly from an end of the space slots, and the third and fourth grooves being located on the two longitudinal segments at equal distances from the space slots and extending from a rim of the longitudinal segments upwardly to the same height as the first and second grooves.

9. The enclosure cap of claim 5, wherein the elastic material is rubber, and wherein the stopper is a single member formed by molding the elastic material.

10. The enclosure cap of claim 5, wherein a central portion of the top portion is about 0.070 to 0.090 inches thick.

* * * * *